US007740457B2

(12) United States Patent
Lehmann

(10) Patent No.: US 7,740,457 B2
(45) Date of Patent: Jun. 22, 2010

(54) MEANS FOR DELIVERY OF FLOWABLE MEDIA, ESPECIALLY LUBRICANTS

(75) Inventor: Frank Günter Lehmann, Spiesen-Elversberg (DE)

(73) Assignee: Hydac System GmbH, Sulzbach/Saar (DE)

( * ) Notice: Subject to any disclaimer, the term of this patent is extended or adjusted under 35 U.S.C. 154(b) by 1074 days.

(21) Appl. No.: 11/401,480

(22) Filed: Apr. 11, 2006

(65) Prior Publication Data

US 2007/0231168 A1 Oct. 4, 2007

(30) Foreign Application Priority Data

Apr. 4, 2006 (DE) ..... 10 2006 015 602

(51) Int. Cl.

| | |
|---|---|
| ***F04B 39/00*** | (2006.01) |
| ***F04B 53/00*** | (2006.01) |
| ***H05B 3/06*** | (2006.01) |
| ***H05B 11/00*** | (2006.01) |

(52) U.S. Cl. ..... 417/313; 392/459; 219/201; 219/536; 219/542

(58) Field of Classification Search ..... 417/313; 392/459; 219/536, 201, 504, 505, 538, 542
See application file for complete search history.

(56) References Cited

U.S. PATENT DOCUMENTS

| | | | | |
|---|---|---|---|---|
| 3,940,591 | A * | 2/1976 | Ting | 219/544 |
| 4,755,657 | A * | 7/1988 | Crim et al. | 219/536 |
| 4,870,249 | A * | 9/1989 | Kayanuma et al. | 219/206 |
| 5,052,897 | A * | 10/1991 | Yamashita et al. | 417/228 |

FOREIGN PATENT DOCUMENTS

| | | |
|---|---|---|
| DE | 196 03 866 | 8/1997 |
| DE | 200 16 206 | 3/2001 |
| DE | 298 25 044 | 8/2004 |
| EP | 1 741 931 | 1/2007 |

* cited by examiner

*Primary Examiner*—Devon C Kramer
*Assistant Examiner*—Peter J Bertheaud
(74) *Attorney, Agent, or Firm*—Roylance, Abrams, Berdo & Goodman, L.L.P.

(57) ABSTRACT

A device for delivery of flowable media, especially of lubricants, includes a pump (1) driven by a motor and forming a component of a line system. At least one heating element (21) activated by energy supply is located outside of the housing (3) of the pump (1) in a position enabling heat transfer to the housing (3).

12 Claims, 3 Drawing Sheets

MEANS FOR DELIVERY OF FLOWABLE MEDIA, ESPECIALLY LUBRICANTS

FIELD OF THE INVENTION

The present invention relates to a means or device for delivery of flowable media, especially of lubricants, with a pump which can be driven by a motor and which forms a component of a line system.

BACKGROUND OF THE INVENTION

In known means of this type, under certain unfavorable operating conditions the danger exists that malfunctions, for example, a drop of delivery output, pump overload, or even its failure will occur. These difficulties can occur especially when overly low oil temperatures occur as lubricating oils are being delivered in a lubricant circuit. These operating states prevail, for example, during cold running phases of certain systems, or occur in wind power plants under winter conditions that can last over longer time intervals. The corresponding strong increase in the viscosity of the lubricating oils to be delivered leads at least to a reduction of the delivery output, resulting in danger to the assigned machinery system, or in less favorable cases leads to overloading or even failure of the pump. This situation in turn entails corresponding subsequent damage to the pertinent system.

SUMMARY OF THE INVENTION

An object of the present invention is to provide a means or device for delivering flowable media, especially lubricants, with operating reliability ensured even when very low temperatures of the line system and the medium to be delivered prevail.

This object is basically achieved by a means or device where heat transfer to the pump housing from the outside is provided. If necessary, a direct temperature increase can take place in the critical, i.e., fault-susceptible area of the line system, specifically directly on the pump. The heating of the pump housing also leads to a corresponding temperature increase of the delivered medium. This heating of the delivered medium causes a corresponding temperature increase of the entire pertinent line system, including an increase of a possible overly low oil temperature in a lubricant circuit.

In especially advantageous exemplary embodiments, at least one heating element is in the form of a self-regulating electrical resistance element with a positive temperature coefficient, for example, in the form of a PTC heating element. Commercially available PTC heating elements include doped polycrystalline ceramic with barium titanate as the base material. These PTC elements ensure rapid heat-up, have good self-regulation behavior, and thus, have a long service life, since there is no danger of overheating due to the self-regulating properties. The use of such PTC elements is also especially advantageous because these elements can automatically maintain a desired temperature level, without control means or temperature sensors being necessary.

Preferably, the housing of the pump has more than one flat outside wall section, to each of which one PTC element is assigned.

Preferably, the PTC heating elements are assigned to those outside wall sections of the housing that are spatially adjacent to the inside displacement elements of the pump. This piston arrangement leads to especially effective and prompt heat-up in the desired region which is critical against insufficient temperatures.

In exemplary embodiments in which on the pump housing fluid input and output define the start and end of the inner pump flow path and in which displacement elements are placed at the same height or coaxial with the input and output on end walls of the pump housing, preferably with the PTC heating element on the side walls joining the end walls and placed at the height of the fluid input and output. This placement yields especially specific heat-up in the area of the inner flow path of the pump.

In advantageous exemplary embodiments, the carrier for the PTC heating elements is an aluminum sheet adjoining the pertinent outside wall sections for heat transfer. The outer side of that sheet adjoins the PTC heating elements made in a flat construction. This support of the PTC heating elements ensures especially good heat transfer to the pump housing.

In this connection, the carrier can be made U-shaped with U-legs extending parallel to one another to form one collar of the two opposing outside side wall sections of the pump housing. On the outside of each U-leg, one PTC heating element is provided.

The PTC heating elements for their part can be held in contact with the U-legs by an enclosure attached to the outside of the U-legs and made from highly heat-conductive metallic material.

The efficiency of the means or device is especially good when the pump housing is surrounded with heat-insulating jacketing, leaving its pump shaft and fluid input and output exposed. Heat losses to the vicinity are then for the most part prevented. This jacketing, with the housing being, for example, cast round, prevents not only heat exit to the outside, but also forms protective jacketing preventing direct access to the PTC heating elements.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
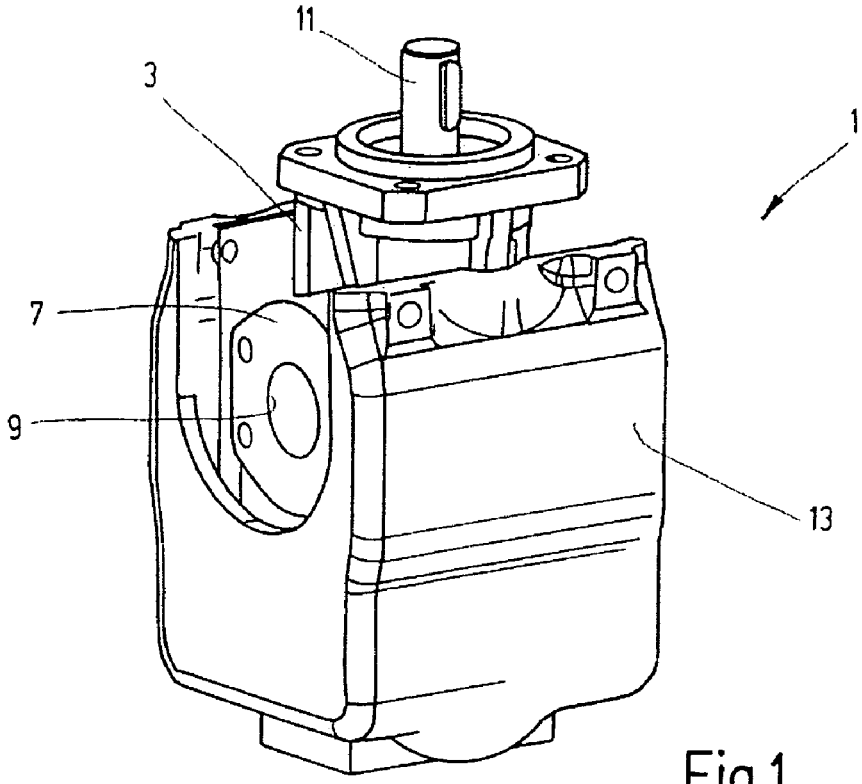
FIG. 1 is a perspective view of a pump according to one exemplary embodiment of the present invention.
Figure 2:
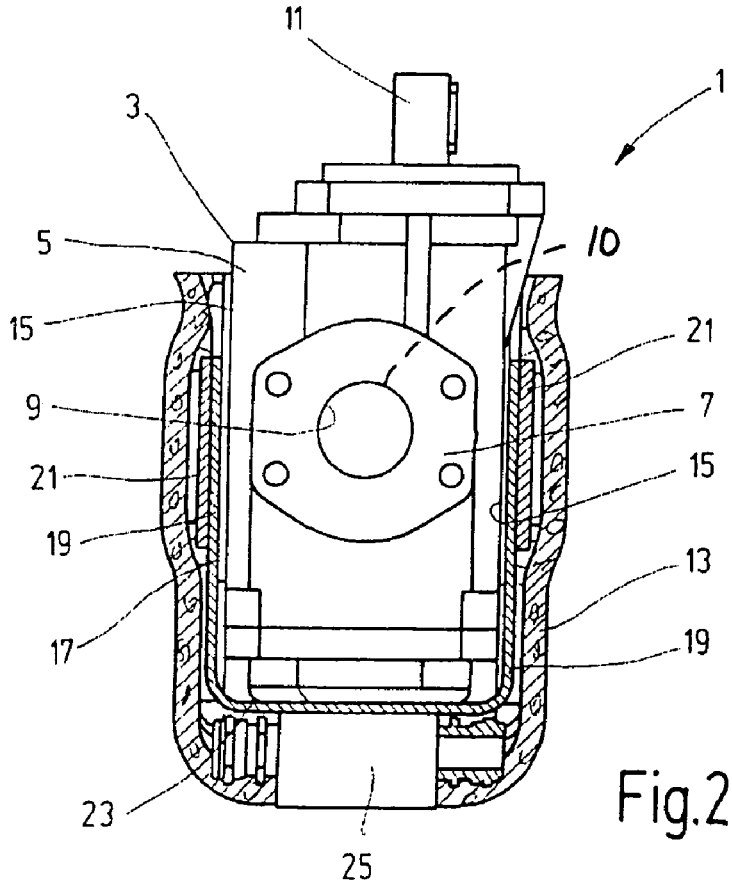
FIG. 2 is a front elevational view, looking at the end wall of the pump housing, with its components surrounding the side walls being shown cutaway or in section.

FIGS. 1 and 2 show a pump 1, with a pump housing 3 which has a fluid input or inlet 9 provided with a connecting flange 7 on the front end wall. Diametrically opposite fluid input 9 on the rear wall (not shown) in the figures a corresponding fluid output or outlet 10 is placed at the same height (coaxially aligned) with the fluid input (inlet) 9. Within the flow path of the pump 1 between the fluid input 9 and fluid output (outlet), a gear pair forms the displacement elements, i.e., the pump 1 is an outside gear pump with a drive shaft 11 located on the top of the housing. As is best shown in FIG. 1, the pump housing 3 is surrounded with heat-insulating jacket 13, leaving exposed the areas of the fluid input 9, of the housing top with the drive shaft 11, and of the area of the fluid output (not shown). Jacket 13 can be a cast or foamed jacket.

FIG. 2 shows the part of the jacket 13 including the side walls 15 of the pump housing 3 extending between the end or front wall 5 and the rear wall. In a vertically cut representation between the side walls 15 and the jacket 13 a U-shaped carrier 17 is provided.

Figures 3, 4, 5:
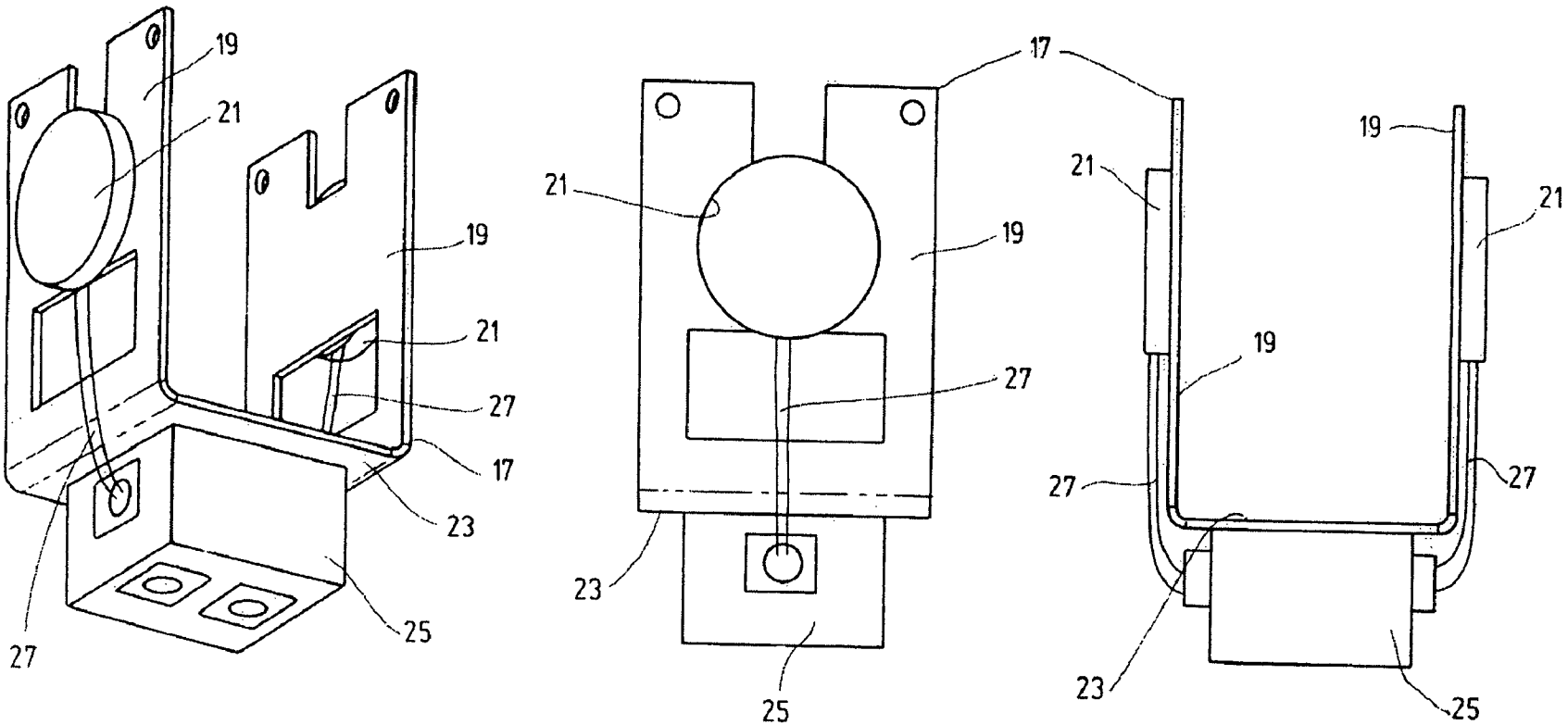
FIG. 3 is a perspective view of part of a carrier forming the collar of the side walls of the pump housing with PTC heating elements located on its outside and their electrical connecting means.
FIG. 4 is a side elevational view of the carrier part of FIG. 3.
FIG. 5 is a front elevational view of the carrier part of FIG. 3.

FIGS. 3 to 5 show the carrier 17 in greater detail. The carrier 17 is shaped from aluminum sheet, and has two U-legs 19 intended to make contact with the side walls 15 of the pump housing 3 and defining or extending in planes parallel to one another. A PTC element unit 21 shown schematically in FIGS. 3 to 5 is attached to the outside of each U-leg 19. U-legs 19 of carrier 17 are connected by a crosspiece 23 enclosing the bottom of the pump housing 3. An electrical connecting means or connector 25 is provided on crosspiece 23 for supplying electrical power to PTC heating elements of PTC element units 21.

Figure 6:
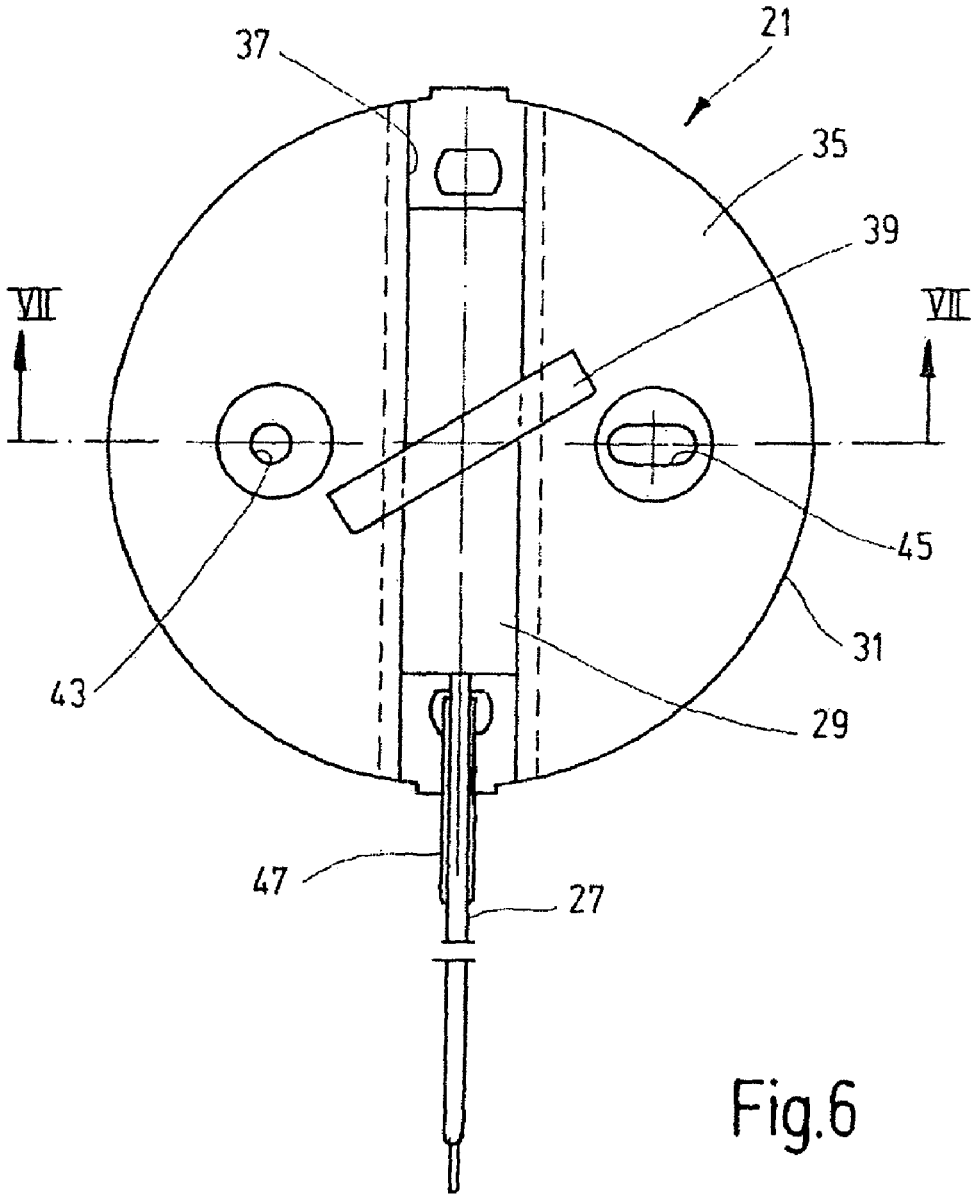
FIG. 6 is a bottom plan view drawn roughly in actual size of a metallic enclosure with a PTC heating element of flat construction held in it.
Figure 7:
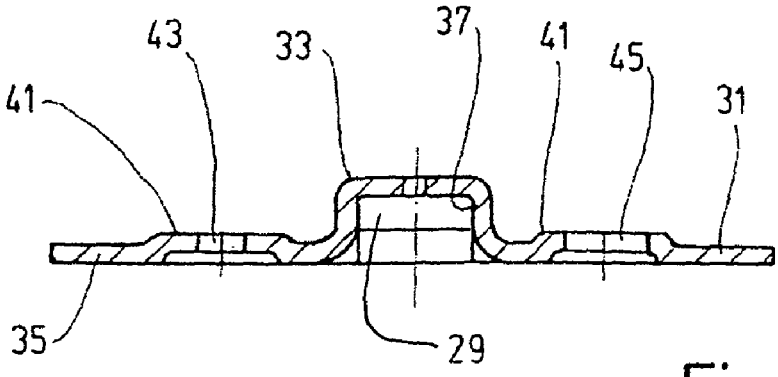
FIG. 7 is a side elevational view in section of the metallic enclosure taken along line VII-VII of FIG. 6.

FIGS. 6 and 7 show details of the PTC element units 21. Each of the element units 21 is provided with its own PTC element 29 in the form of a flat cuboid. The PTC element 29 is located in an enclosure 31 made in the form of a round disk of metal with good heat conductivity and provided with profiling. The enclosure 31 has central profile 33 forming a receiving channel 37 in which the PTC element 29 is fixed by a heat-resistant adhesive film strip 39, in the exemplary embodiment a Kapton® strip. The bottom 35 of the enclosure 31 is intended for contact with the pertinent U-leg 19. On either side of the receiving channel 37, profiles 41 of low height with a round mounting hole 43 and an oblong hole 45 are provided for forming a screw connection between the enclosure 31 and the pertinent U leg 19. Carrier 17 mounts PTC heating elements 29 at the height of the fluid input 9 and the fluid out output.

Connecting wires 27 intended for power supply of the PTC element 29 are connected in the manner conventional for PTC elements 29 to the flat metal electrodes provided thereon. In the end area bordering the PTC element 29, the connecting wires 27 are surrounded by a silicone insulating tube 47. Moreover the transition area between the end of the connecting wires 27 provided with the insulating tube 47 can be sealed with rubber in the area bordering the PTC element 29.

The enclosure 31 attached to the pertinent U-leg 19 of the carrier 17 forms a heat conducting plate for transfer of the heat generated by the PTC element 29 to the aluminum sheet of the pertinent U-leg 19 adjoining the pertinent side wall 15 of the pump housing 3 as a heat transfer agent. This thermal coupling makes it possible using the self-regulating characteristic of the PTC heating element 29 to maintain the desired temperature during changing operating states on the pump housing 3, without the need for control electronics for this purpose.

The present invention is described above using the example of an outside gear pump, but can be used likewise in pumps of a different design, for example, for inside gear pumps, screw pumps, vane cell pumps, radial piston pumps or in pumps with a different operating principle. In any case, it is advantageous to attach the pertinent PTC heating elements to the respective pump housing in a position such that there is good thermal coupling to the pertinent inner displacement elements. While the present invention is explained using one example in which two element units 21 with one contained PTC element 29 each are used, there could be a different number of PTC elements 29, and other designs different from the flat execution can be used, for example, PTC elements with a round or rectangular cartridge shape.

While one embodiment has been chosen to illustrate the invention, it will be understood by those skilled in the art that various changes and modifications can be made therein without departing from the scope of the invention as defined in the appended claims.

What is claimed is:

1. A device for delivering flowable media, comprising:

a pump driven by a motor, forming a component of a line system and having a pump housing with opposite first and second end walls joined by first and second side walls;

a fluid input and a fluid output aligned on said first and second end walls, respectively, and defining a start position and an end position of an inner flow path of said pump;

displacement elements of said pump in said pump housing;

at least one heating element activated by an energy supply located outside of said pump housing in a position to transfer heat to said pump housing, said heating element unit including a first PTC heating element on a flat section of an outside surface of said first side wall at a height of said fluid input and said fluid output;

a second PTC heating element attached on a flat section of an outside surface of said second side wall of said pump housing, said flat sections being adjacent said displacement elements in said pump housing; and a carrier formed of an aluminum sheet mounting said first and second PTC heating elements to said flat sections of said outside surfaces of said pump housing to transfer heat to said pump housing, said PTC heating elements having flat outer sides adjoining said carrier.

2. A device according to claim 1 wherein said carrier is U-shaped with parallel U-legs and forms a collar extending about said flat sections of said outside surfaces of said pump housing, each of said U-legs supporting one of said PTC heating elements.

3. A device according to claim 2 wherein said U-legs are connected by a crosspiece enclosing a bottom part of said pump housing; and an electrical connector is on an outside surface of said crosspiece to supply electrical power to said PTC heating elements.

4. A device according to claim 3 wherein enclosures hold said PTC heating elements in contact with said U-legs, are attached to outside surfaces of said U-legs, and are formed of highly heat-conductive metallic material.

5. A device according to claim 4 wherein said PTC heating elements adjoin said U-legs over a large area thereof.

6. A device according to claim 1 wherein said pump includes a pump shaft; and a heat-insulating jacket surrounds said pump housing and said heating elements while leaving exposed said pump shaft, said fluid input and said fluid output.

7. A device for delivering flowable media, comprising:

a pump driven by a motor, forming a component of a line system and having a pump housing with opposite first and second end walls joined by first and second side walls, said side walls having outside surface sections;

a fluid input and a fluid output aligned on said first and second end walls, respectively, defining a start position and an end position of inner flow path of said pump;

displacement elements of said pump in said pump housing between said fluid input and fluid output, said outside surface sections being adjacent said displacement elements in said pump housing;

a carrier formed of an aluminum sheet and placed on said outside surface sections; and first and second PTC heating elements having flat surfaces mounted on said carrier and activated by electrical energy supplied from outside said pump housing to transfer heat to said pump housing.

8. A device according to claim 7 wherein said carrier is U-shaped with parallel U-legs, and forms a collar extending about said outside surface sections of each of said U-legs supporting one of said PTC heating elements.

9. A device according to claim 8 wherein said U-legs are connected by a crosspiece enclosing a bottom part of said pump housing; and an electrical connector is on an outside surface of said crosspiece to supply electrical power to said PTC heating elements.

10. A device according to claim 9 wherein enclosures hold said PTC heating elements in contact with said U-legs, are attached to outside surfaces of said U-legs, and are formed of highly heat-conductive metallic material.

11. A device according to claim 9 wherein said PTC heating elements adjoin said U-legs over a large area thereof.

12. A device according to claim 7 wherein said pump includes a pump shaft; and a heat-insulating jacket surrounds said pump housing and said PTC heating elements while leaving exposed said pump shaft, said fluid input and said fluid output.

* * * * *